United States Patent [19]

Busch

[11] 4,019,618

[45] Apr. 26, 1977

[54] REVERSIBLE RIBBON DRIVE MECHANISM

[75] Inventor: Richard E. Busch, La Puente, Calif.

[73] Assignee: Addmaster Corporation, San Gabriel, Calif.

[22] Filed: Apr. 8, 1976

[21] Appl. No.: 674,814

[52] U.S. Cl. ..... 197/161

[51] Int. Cl.[2] ..... B41J 33/44

[58] Field of Search ..... 197/160, 161, 162, 163, 197/164, 165, 151; 101/336

[56] References Cited

UNITED STATES PATENTS

| | | | |
|---|---|---|---|
| 675,659 | 6/1901 | Kimball | 197/161 X |
| 1,522,874 | 1/1925 | Ekman | 197/161 |
| 1,544,891 | 7/1925 | Crook | 197/165 |
| 1,578,209 | 3/1926 | Rosien | 197/160 |
| 1,971,568 | 8/1934 | Kranz | 101/336 |
| 2,126,347 | 8/1938 | Ruttiman | 197/161 |
| 3,602,353 | 8/1971 | Chvatlinsky et al. | 197/161 |

FOREIGN PATENTS OR APPLICATIONS

| | | | |
|---|---|---|---|
| 914,618 | 7/1954 | Germany | 197/162 |
| 878,767 | 10/1961 | United Kingdom | 197/161 |

*Primary Examiner*—Ernest T. Wright, Jr.
*Attorney, Agent, or Firm*—Fred N. Schwend

[57] ABSTRACT

A diameter sensing, reversible ribbon drive mechanism including disabling cams pivotal about the axes of the ribbon spools for disabling the drive and detent pawls for one spool and enabling similar pawls for the other spool. A first link connecting the drive pawls is oscillated during each printing cycle. A second link connecting the disabling cams carries a coupler which is moved into one coupling relation with the first link by a diameter sensing device which senses a depleted condition of one of the spools to cause the first link to transfer movement to the second link to reverse the conditions of the drive and detent previously enabled pawls.

13 Claims, 4 Drawing Figures

FIG. 1.
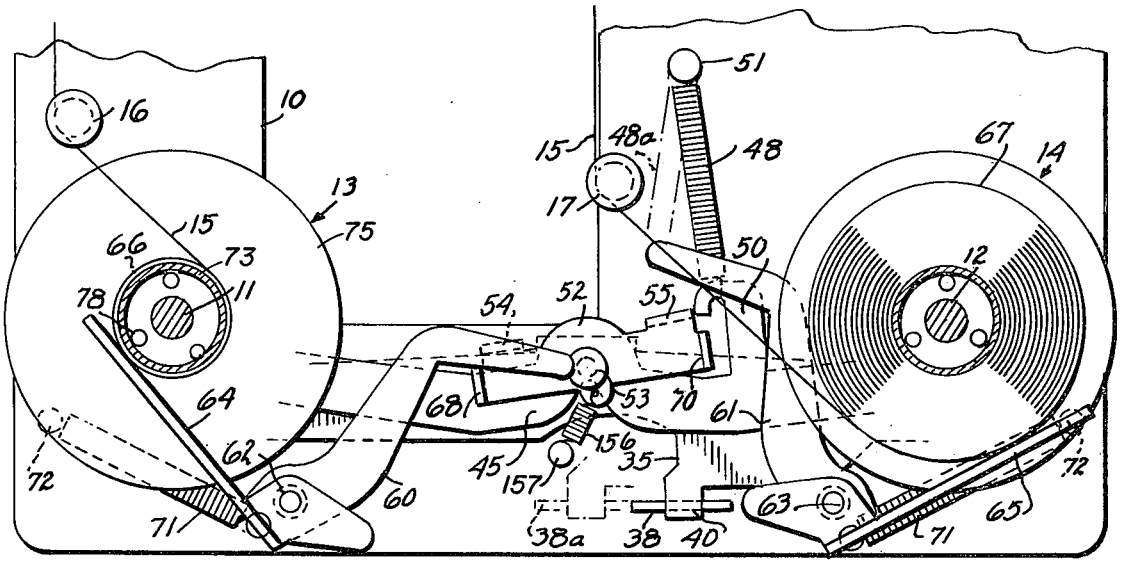
FIG. 2.
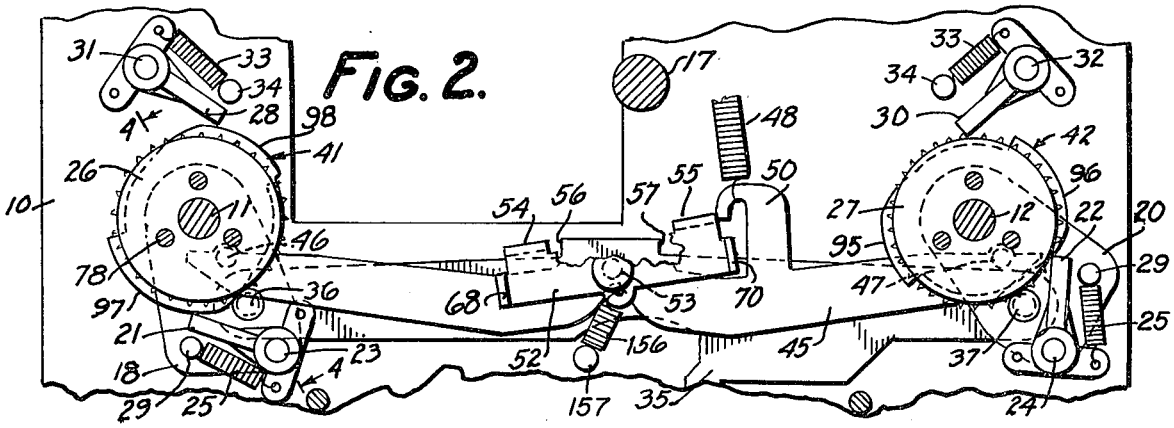
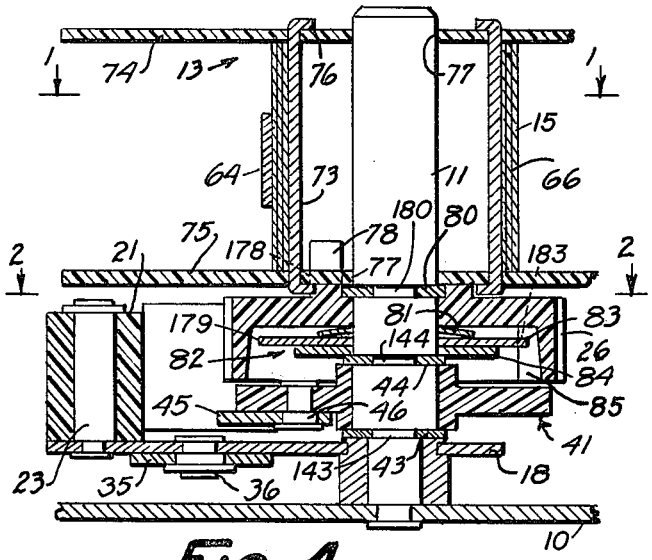
FIG. 4.
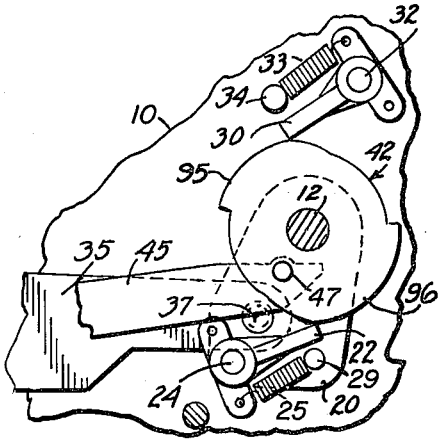
FIG. 3.

REVERSIBLE RIBBON DRIVE MECHANISM

BACKGROUND OF THE INVENTION

1. Field of the Invention

This invention relates to reversible printing ribbon drive mechanisms for data printers, such as are found in business machines or the like.

2. Description of the Prior Art

Heretofore, reversible printing ribbon drive mechanisms for business machines, etc., have generally been of the eyelet sensing or tension sensing type. In the eyelet sensing type, the eyelet or similar projection at each end of the ribbon actuates a reversing control device to reverse the direction of ribbon feed when the end of the ribbon on a ribbon supply spool is approached. Although eyelet sensing controls generally work satisfactorily since they can derive a reliable controlling effect from the eyelets, they require that all printing ribbons used in connection therewith be provided with such reversing control eyelets.

In the tension sensing type, reversal of the ribbon feed mechanism is effective upon an increase in tension in the ribbon which normally occurs when the ribbon becomes depleted from the ribbon spool forming the supply spool. Difficulty is encountered in ribbon feed mechanisms of this type when the ribbon must be fed around a tortuous path or through a plurality of ribbon guides, or otherwise when appreciable drag is applied against the ribbon which increases the load against which the ribbon feed mechanism must operate in order to incrementally step the ribbon endwise through its path. Here, the additional, and often erratic, drag encountered by the ribbon may cause premature reversal of the ribbon drive.

SUMMARY OF THE INVENTION

A principal object of the present invention is to provide a reversible ribbon drive mechanism which overcomes the above problems.

Another object is to provide a reversible ribbon drive mechanism which is uneffected by the tension of the ribbon during ribbon feeding operations.

Another object is to provide a reversible ribbon feed mechanism which provides a positive incremental drive of the ribbon in either of opposite directions.

Another object is to provide a reversible ribbon feed mechanism effective to cause reversal of the ribbon feeding mechanism when the diameter of the ribbon in the supply roll reaches a predetermined diameter.

Another object is to provide a simple and inexpensively manufactured reversible ribbon feeding mechanism for a printing ribbon which is carried on a pair of widely spaced spools.

According to the present invention, pawl and ratchet mechanisms are provided to drive spaced respective spools carrying opposite ends of a printing ribbon. The pawl devices are driven in unison by an oscillating link. Pawl disabling cams are provided which are connected by a second link carrying a coupler. The latter is controlled by diameter sensing levers which cause the coupler to couple the second link to the first link when the diameter of the ribbon roll forming the supply roll decreases to a predetermined minimum diameter and when the first link is moved in one direction only to thereby set the disabling cams to disable one pawl device. The coupler also couples the second link to the first when the diameter of the other roll, now acting as a supply roll, decreases to such predetermined minimum diameter and when the first link is moving in the opposite direction only to set the disabling cams to disable the other pawl device.

BRIEF DESCRIPTION OF THE DRAWING

The manner in which the above and other objects of the invention are accomplished will be readily understood on reference to the following specification when read in conjunction with the accompanying drawing, wherein:

FIG. 1 is a top sectional plan view of a reversible ribbon driving mechanism embodying a preferred form of the present invention and is taken substantially along the line 1—1 of FIG. 4.

FIG. 2 is a sectional plan view similar to FIG. 1 but taken along line 2—2 of FIG. 4.

FIG. 3 is a fragmentary sectional plan view showing the feed pawl, detent pawl and pawl disabling cam for the right hand ribbon spool in an alternate position from that depicted in FIG. 2.

FIG. 4 is an enlarged transverse sectional view taken substantially along the line 4—4 of FIG. 2.

DESCRIPTION OF THE PREFERRED EMBODIMENT

Referring to the drawing, the ribbon driving mechanism is mounted on a base plate 10 forming part of the frame of a business machine (not shown). Spaced similar upstanding posts 11 and 12 are secured to the base plate 10 to rotatably support flanged ribbon spools generally indicated at 13 and 14, on which the opposite ends of an inked printing ribbon 15 are rolled. The ribbon 15 is guided around a series of ribbon guides, two of which are shown at 16 and 17, mounted on the base plate 10. The ribbon 15 passes through a printing mechanism (not shown) where an imprint of type characters is transmitted through the ribbon 15 and onto a record medium (also not shown), such as a paper strip.

According to the present invention, arms 18 and 20 are pivotally mounted on the posts 11 and 12, respectively, and have feed pawls 21 and 22 pivotally mounted thereon at 23 and 24, respectively. Springs 25 are tensioned between the pawls 21, 22 and studs 29 on the respective arms 18 and 20 to urge the pawls 21 and 22 toward engagement with toothed ratchet members 26 and 27 rotatably mounted on the posts 11 and 12, respectively.

Detent or anti-back up pawls 28 and 30 are pivotally mounted at 31 and 32, respectively, on the base plate 10 and are urged toward engagement with ratchet members 26 and 27 by springs 33 tensioned between the pawls 28, 30 and frame studs 34.

A first link 35 is pivotally connected at 36 and 37, at its ends, to the arms 18 and 20 to cause the latter to rock in unison about their posts 11 and 12. For this purpose, a bifurcated actuating member 38 (FIG. 1) embraces a tongue 40 formed on link 35 and during each cycle of the machine on which the ribbon mechanism is mounted, member 38 is oscillated between its full line position shown in FIG. 1 and its alternate dot-dash line position 38*a*. This movement is effective to rock the arms 18 and 20 from their full line counterclockwise rocked positions of FIG. 2 to alternate clockwise rocked positions exemplified by the showing of arm 20 in FIG. 3.

Pawl disabling cams 41 and 42 are pivotally mounted on the posts 11 and 12, respectively, and are located axially on such respectively,posts 11 and 12 by spring clips 43 and 44 (FIG. 4) which engage grooves 143 and 144, in the posts 11 and 12.

A second link 45 is pivotally connected at 46 and 47 to disabling cams 41 and 42, respectively, to move cams 41 and 42 in unison about the posts 11 and 12 from their counterclockwise rocked positions shown in FIG. 2 to alternate clockwise rocked positions exemplified by the showing of cam 42 in FIG. 3. An overcenter spring 48 is tensioned between a hook shaped projection 50 on link 45 and a frame stud 51. Such spring 48 yieldably holds the link 45 and disabling cams 41 and 42 in either their clockwise or counterclockwise rocked positions.

A coupler 52 is pivotally mounted on the link 45 at 53 and has ears 54 and 55 formed thereon on opposite sides of the pivot 53. Such ears 54 and 55 overlie the link 35 and are adapted to be engaged by respective spaced shoulders 56 and 57 formed on link 35.

A light overcenter spring 156 is tensioned between the coupler 52, directly below the pivot 53, and a frame stud 157 mounted on base 10. Spring 156 is weaker than spring 48 and therefore cannot move the link 45 against the action of spring 48. When link 45 is in its right hand location illustrated in FIGS. 1 and 2, spring 156 urges the coupler 52 clockwise (unless otherwise retained) toward a position in which the ear 55 is located in the path of the shoulder 57 of link 45. On the other hand, when the link 45 is in its left hand position, illustrated partly in FIG. 3, the spring 156 urges the coupler 52 counterclockwise towards its position depicted in FIGS. 1 and 2 wherein the ear 54 is located in the path of shoulder 56 on the link 35.

Diameter sensing levers 60 and 61 are pivotally supported at 62 and 63 on the base plate 10 and have arms 64 and 65 engageable with rolls of ribbon 66 and 67 wound on the spools 13 and 14, respectively. Levers 60 and 61 overlie ears 68 and 70 formed on the coupler 52 and are urged toward engagement with such ears 68, 70 by springs 71 tensioned between the levers 60, 61 and frame studs 72. Thus, the levers 60 and 61 follow respective ribbon rolls 66 and 67 as the latter increase and decrease in diameter.

It should be noted that springs 71 are both stronger than spring 156 and therefore either sensing lever 60 or 61 can rock the coupler 52 against the action of spring 156.

Referring to FIG. 4, each ribbon spool, i.e. 13, comprises a hollow core 73 secured at its ends to spaced spool flanges 74 and 75 by ears 76 which are bent over to retain the flanges 74 and 75 thereon. Aligned bearing openings 77 are formed in the spool flanges 74 and 75 to fit over the respective posts 11 and 12 to rotatably support the spools 13 and 14.

Each spool, i.e. 13, is coupled to its respective ratchet member, i.e. 26, by three spaced drive pins 78 extending upwardly from the ratchet member, i.e., 26, and fitting within aligned holes 178 in the lower spool flange 75.

Each spool, i.e. 13, rests on the underlying ratchet member, i.e. 26, which is held against a spring clip 80 mounted within a groove 180 in the post, i.e. 12, by a warped or Belleview spring 81 forming part of a friction drive clutch generally indicated at 82. Such clutch 82 is provided for each of the ratchet members 26 and 27 to apply a drag against movement of both spools 13 and 14 to thereby maintain the ribbon 15 in a taut condition at all times.

The clutch 82 includes a friction disk 83 which is interposed between the tensioned spring 81 and a plate 84, the disk 83 being free on the post 11. Plate 84 is tightly fitted on post 11 and is thus not rotatable. Therefore, a friction force is exerted between the disk 83 and plate 84. Disk 83 is constrained to rotate with the ratchet member, i.e. 26, by virtue of a vertically extending rib 85 formed on the ratchet member i.e., 26, and engaging a suitable notch 183 formed in the periphery 179 of the disk 83.

Describing now the operation of the ribbon feeding mechanism, and assuming the mechanism is in its condition shown in FIGS. 1 and 2 wherein the ribbon roll 66 on spool 13 is substantially depleted and both links 35 and 45 are in their right hand illustrated positions. In this condition, the spring 71 holds sensing lever 60 in a clockwise rocked position to rock the coupler 52 counterclockwise against the action of its spring 156 to locate its ear 54 in the path of the shoulder 56 of link 35. Therefore, when the link 35 is next moved to the left by the actuating member 38, the shoulder 56 will pick up coupler 52 and link 45, moving the same to their leftmost positions and thereby rocking the disabling cams 41 and 42 clockwise from their positions illustrated in FIG. 2 to positions exemplified in FIG. 3. Accordingly, diametrically opposed cam lobes 95 and 96 on cam 42 will rock the drive pawl 22 and detent pawl 30 outwardly, as shown in FIG. 3, to positions where they will be unable to engage the teeth of ratchet member 27. Concurrently, similar diametrically opposed cam lobes 97 and 98 on cam 41 will recede from under drive pawl 21 and detent pawl 31, allowing such pawls 21 and 31 to engage the teeth of ratchet member 26. Now, as the link 35 is subsequently oscillated during each cycle of operation, the pawl 21 will incrementally advance ratchet member 26 to wind the ribbon 15 onto the ribbon roll 66. At this time, the pawl 22 will merely more over the cam lobe 96 through an idle stroke and the ribbon 15 will be withdrawn from roll 67.

Spring 48 which has now assumed an alternate position shown by dot-dash lines **48*a* in FIG. 1, will continue to hold the link 45 in its leftmost position, thus continuing to enable pawls 21 and 28 and to disable pawls 22 and 30. However, when the ribbon 15 becomes substantially depleted from ribbon roll 67, the sensing lever 61 will rock the coupler 52 clockwise to locate its ear 55 in the path of the shoulder 57 on link 35 so that during the next oscillation of link 35, the shoulder 57 will pick up the coupler 52 to drive the link 45 and disabling cams 41 and 42 back to their initial positions shown in FIGS. 1 and 2. In such condition, the cam 42 will enable pawls 22 and 30, and cam 41 will disable pawls 21 and 28**.

It will be noted that arms 64 and 65 of diameter sensing levers 60 and 61, respectively, may be adjusted by bending the same to cause the coupler 52 to engage one or the other of the shoulders 56 and 57 on link 35 when the ribbon rolls 66, 67 on the associated spools 13 and 14 reach different diameters.

It will be obvious to those skilled in the art that many variations may be made in the exact construction shown without departing from the spirit and scope of this invention.

I claim:

1. In a ribbon mechanism having a pair of spaced ribbon spools, a ribbon extending between said spools, and ratchet members connected to said spools for rotation about spaced parallel axes;

reversible feeding mechanism for said ribbon comprising drive pawl devices engageable with respective ones of said ratchet members, a first link connecting said pawl devices, means for oscillating said link to actuate said pawl devices to advance said ratchet members, disabling devices for respective ones of said pawl devices, a second link connecting said disabling devices to move in unison from a first condition to a second condition, said disabling devices being effective in said first condition to disable one of said pawl devices and being effective in said second condition to disable the other of said pawl devices, a coupler, said coupler being settable in a first position or a second position, said coupler being effective in said first position to couple said second link to said first link upon movement of said first link in a first direction only whereby to cause said second link to move said disabling devices to said first condition, said coupler being effective in said second position thereof to couple said second link to said first link upon movement of said first link in a second direction only whereby to cause said second link to move said disabling devices to said second condition, and sensing means controlled by a ribbon roll on a first one of said spools for moving said coupler into said first position when the diameter of the ribbon roll on said first spool reaches a predetermined diameter, said sensing means being controlled by a ribbon roll on the other of said spools for moving said coupler into said second position when the diameter of the ribbon roll on said other spool reaches a predetermined diameter.

2. Reversible feeding mechanism as defined in claim 1 comprising means applying a drag to both of said ratchet members.

3. Reversible feeding mechanism as defined in claim 1 wherein said pawl devices are movable about said axes.

4. Reversible feeding mechanism as defined in claim 1 wherein said disabling devices comprise camming elements.

5. Reversible feeding mechanism as defined in claim 4 wherein said camming elements are movable about said axes.

6. Reversible feeding mechanism as defined in claim 1 comprising detent pawls engageable with said ratchet members, said disabling devices being effective in said first condition to concurrently disable the detent pawl and the pawl device for one of said ratchet members and effective in said second condition to concurrently disable the detent pawl and the pawl device for the other of said ratchet members.

7. Reversible feeding mechanism as defined in claim 6 wherein said disabling devices comprise cam elements engageable with said detent pawls and said pawl devices.

8. Reversible feeding mechanism as defined in claim 1 comprising yieldable means for maintaining said coupler in said positions thereof to which said coupler is set by said sensing means.

9. Reversible feeding means as defined in claim 1 comprising means on said second link pivotally supporting said coupler for movement into either of said positions thereof.

10. Reversible feeding mechanism as defined in claim 1 comprising yieldable means for maintaining said second link in any of said positions to which it is set by said first link.

11. Reversible feeding mechanism as defined in claim 1 wherein said sensing means comprises members engaging said ribbon rolls and each effective when the diameter of the respective roll is reduced to a predetermined value to move said coupler from one of said positions thereof to the other.

12. In a ribbon mechanism having a pair of spaced ribbon spools, a ribbon extending between said spools, and ratchet members connected to said spools for rotation about spaced parallel axes;

reversible feeding mechanism for said ribbon comprising drive pawl devices engageable with respective ones of said ratchet members, a first link connecting said pawl devices, means for oscillating said link to actuate one of said pawl devices to advance one of said respective ratchet members upon movement of said link in a first direction and to actuate the other of said pawl devices to advance the other of said respective ratchet members upon movement of said link in an opposite direction, disabling devices for said pawl devices, a second link connecting said disabling devices to move in unison from a first condition to a second condition, said disabling devices being effective in said first condition to disable one of said pawl devices and being effective in said second condition to disable the other of said pawl devices, a coupler carried by said second link, said coupler being settable in a first position or a second position, said coupler being effective in said first position to couple said second link to said first link upon movement of said first link in said first direction only whereby to cause said second link to move said disabling devices to said first condition, said coupler being effective in said second position thereof to couple said second link to said first link upon movement of said first link in said second direction only whereby to cause said second link to move said disabling devices to said second condition, and sensing means controlled by a ribbon roll on a first one of said spools for moving said coupler into said first position when the diameter of the ribbon roll on said first spool reaches a predetermined diameter, said sensing means being controlled by a ribbon roll on the other of said spools for moving said coupler into said second position when the diameter of the ribbon roll on said other spool reaches a predetermined diameter.

13. In a ribbon mechanism having a pair of spaced ribbon spools, a ribbon extending between said spools, and ratchet members connected to said spools for rotation about spaced parallel axes;

reversible feeding mechanism for said ribbon comprising drive pawl devices for driving respective ones of said ratchet members, a first link connecting said pawl devices, means for oscillating said link to actuate said pawl devices in unison, disabling devices for said pawl devices, a second link connecting said disabling devices to move in unison from a first condition to a second condition, said disabling devices being effective in said first condition to disable one of said pawl devices and being effective in said second condition to disable the other of said pawl devices, a coupler, said coupler being settable in a first position or a second position, said coupler being effective in said first position to couple said second link to said first link upon movement of said first link in a first direction only whereby to cause said second link to move said disabling devices to said first condition, said coupler being effective in said second position thereof to couple said second link to said first link upon movement of said first link in a second direction only whereby to cause said second link to move said disabling devices to said second condition, and means for setting said coupler into either of said positions thereof.

* * * * *